US005661929A

United States Patent [19]

Ross

[11] Patent Number: 5,661,929

[45] Date of Patent: Sep. 2, 1997

[54] PARAPET MOLDING FLASHING INSTALLATION SYSTEM

[76] Inventor: Steve Ross, 18712 Rancho Circle La., Yorba Linda, Calif. 92886

[21] Appl. No.: 638,647

[22] Filed: Apr. 29, 1996

[51] Int. Cl.[6] ..... E04F 13/18

[52] U.S. Cl. ..... 52/58; 52/60; 52/96; 52/300; 52/309.7; 52/716.2; 52/745.21; 52/745.06

[58] Field of Search ..... 52/309.2, 309.7, 52/300, 311.1, 57–62, 96, 716.1, 716.2, 745.06, 745.21, 746.11, 169.14

[56] References Cited

U.S. PATENT DOCUMENTS

| | | | |
|---|---|---|---|
| 3,394,513 | 7/1968 | Nerem | 52/309.2 |
| 3,401,494 | 9/1968 | Anderson | 52/309.2 |
| 4,443,988 | 4/1984 | Coutu | 52/309.2 X |
| 4,480,416 | 11/1984 | Judkins et al. | 52/309.7 X |
| 4,517,782 | 5/1985 | Shamszadeh | 52/309.7 |
| 4,848,045 | 7/1989 | Nichols et al. | 52/96 X |
| 5,410,849 | 5/1995 | Christopher | 52/309.2 |

*Primary Examiner*—Robert Canfield
*Attorney, Agent, or Firm*—Goldstein & Associates

[57] ABSTRACT

A parapet molding flashing installation system, for a foam molding to a building. The molding having an upper surface, and having a channel extending along the molding. The channel having an upper opening along the upper surface of the molding. An anchor insert extends in the channel and has an exposed face at the upper opening of the channel for attaching a flashing cap to the anchor insert to thereby secure the flashing cap to the anchor insert.

9 Claims, 2 Drawing Sheets

Fig. 3
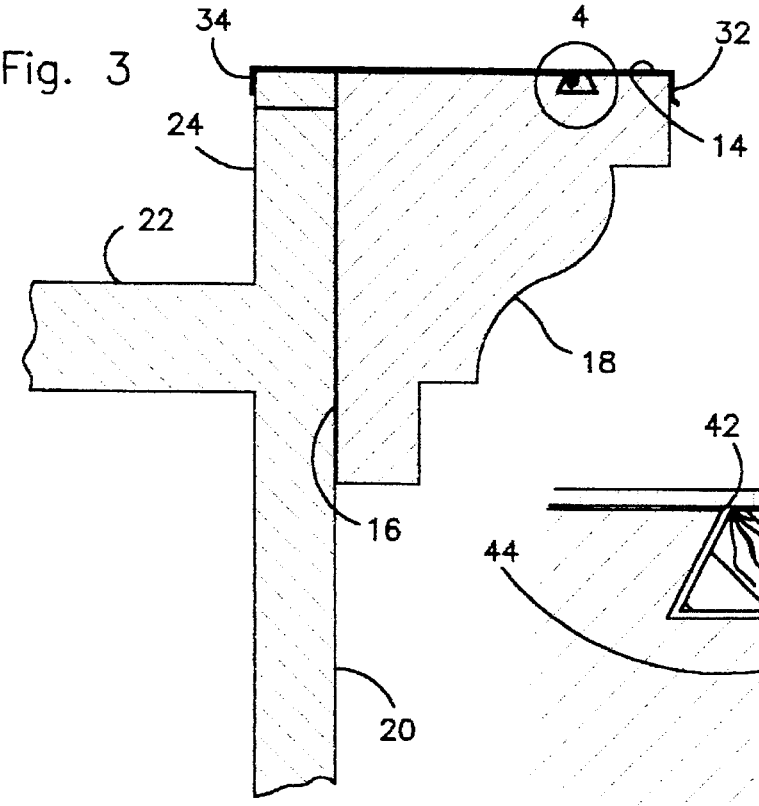
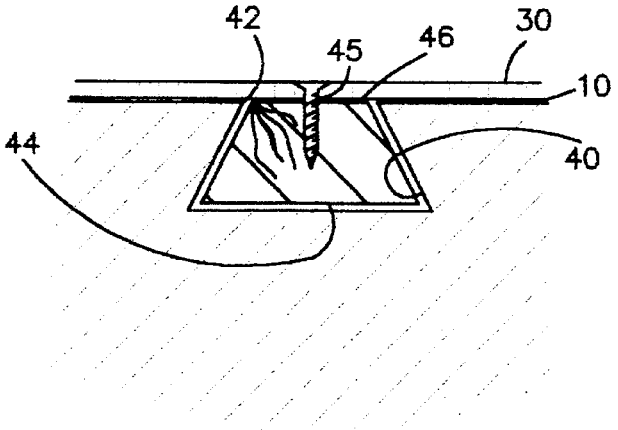
Fig. 4
Fig. 5
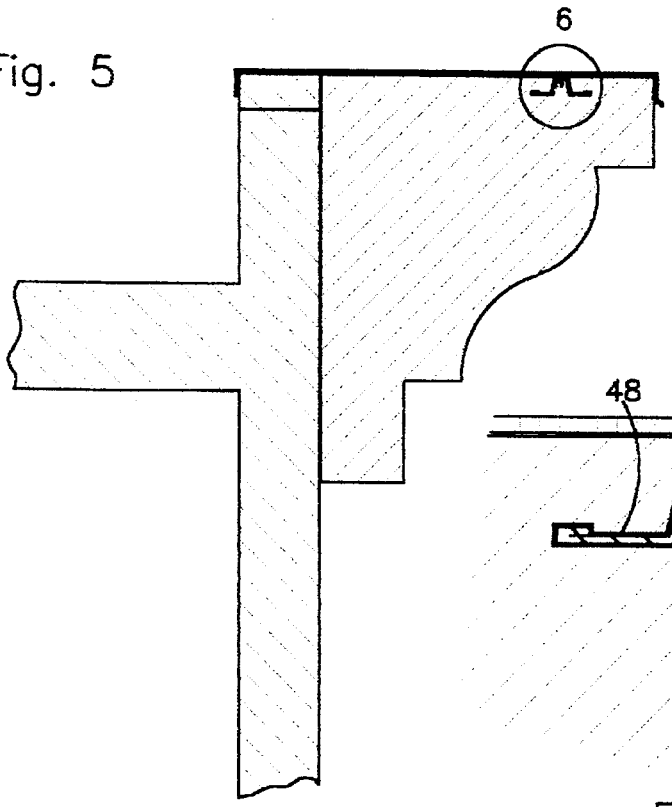
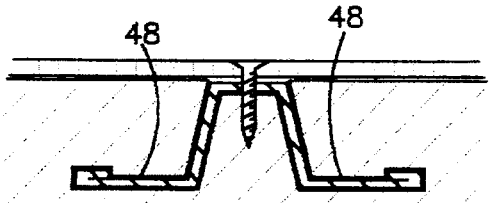
Fig. 6

PARAPET MOLDING FLASHING INSTALLATION SYSTEM

BACKGROUND OF THE INVENTION

The invention relates to a parapet molding flashing installation system. More particularly, the invention relates to a system for installing a decorative parapet molding, while eliminating shortcomings inherent in current flashing installation practices.

Foam moldings are commonly used to adorn the roof edge, or "parapet" of modern structures. The foam molding is often shaped to provide the appearance of stone carved ornaments inherent in 19th century architecture. Once finished to match the building, the foam parapet adornment gives the appearance of being an integral part of the building structure.

The foam molding is normally installed using a complicated procedure involving adhesives, plywood, and sheet metal. The foam molding is first attached to the side of the building using powerful adhesives. The parapet and molding is then covered with plywood. To seal the plywood and foam from the elements, the plywood is covered with sheet metal. However, if any moisture reaches the plywood before it is covered with the sheet metal and sealed, the plywood might warp or distort, creating an irregular and uneven surface.

U.S. Pat. No. 5,272,846 to Kelley et al.; U.S. Pat. No. 4,912,900 to Yeamans; and U.S. Pat. No. 5,031,367 to Butzen disclose various roof edge mounting systems and techniques.

U.S. Pat. No. 5,392,576 to Yeamans and U.S. Pat. No. 4,970,832 to van Herpen disclose other roof covering techniques.

While these units may be suitable for the particular purpose employed, or for general use, they would not be as suitable for the purposes of the present invention as disclosed hereafter.

SUMMARY OF THE INVENTION

It is an object of the invention to provide a system for easily installing a decorative fixture, by easily allowing mounting of a molding at the parapet of the building.

It is another object of the invention to eliminate the need for the plywood covering typically employed during installation of the molding.

It is a further object of the invention to provide a channel in the molding which receives a anchor insert to facilitate mounting a sheet metal flashing cap directly to the molding.

It is a still further object of the invention that the channel is shaped to maximize support for the molding, while exposing a portion of the insert at an upper surface of the molding to allow for easy attachment between the flashing cap and the insert.

The invention is a parapet molding anchoring system, for a foam molding to a building. The molding having an upper surface, and having a channel extending along the molding. The channel having an upper opening along the upper surface of the molding. An anchor insert extends in the channel and has an exposed face at the upper opening of the channel for attaching a flashing cap to the anchor insert to thereby secure the flashing cap to the anchor insert.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 3 is a cross sectional view, similar to FIG. 2 except taken orthogonal to the cutting plane line in FIG. 1.

FIG. 4 is an enlarged cross sectional view, taken in the area of circle 4 in FIG. 3.

FIG. 5 is a cross sectional view of a further embodiment of the invention.

FIG. 6 is an enlarged cross sectional view, illustrating the further embodiment, taken in the area of circle 6 in FIG. 5.

DETAILED DESCRIPTION OF THE PREFERRED EMBODIMENTS

Figure 1:
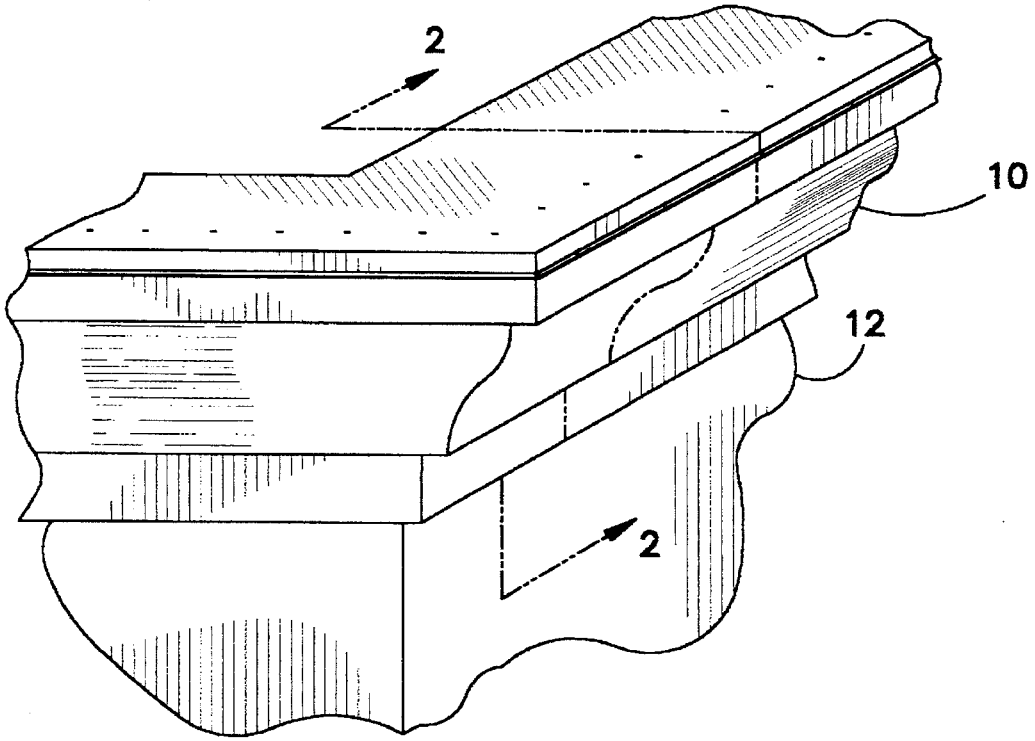
FIG. 1 is a diagrammatic perspective view illustrating a molding installed at the parapet of a building, in accordance with the present invention.

FIG. 1 illustrates a completed installation of a molding 10 on a building 12. When a forward portion of the molding 10 and building 12 are removed in FIG. 2, internal details of a mounting system of the present invention are revealed.

Referring to FIG. 3, the molding has an upper surface 14, an inner surface 16, and a decorative face 18. The molding is made of foam, generally expanded polystyrene. The building 12 has a wall 20, a roof 22, and a parapet 24, which is a vertical extension of the wall 20 above the roof 22.

The molding 10 is initially attached to the building 12 by applying powerful adhesives between the inner surface 16 of the molding 10 and the parapet 24. Preferably, a cementitious adhesive is used—a substance capable of creating a strong bond between foam and masonry.

The molding and parapet are covered with flashing cap 30, which is typically sheet metal. The flashing cap 30 is bent at the junction between the upper surface 14 and decorative face 18 of the molding forming a decorative face lip 32. The flashing cap 30 is also bent just beyond the parapet 24 to form a parapet lip 34. The flashing cap 30 provides a waterproof seal for the molding 10 and the joint between the molding 10 and the building 12.

FIG. 4 illustrates the manner of attachment of the flashing cap 30 to the molding 10 according to the present invention. The molding 10 has a channel 40 extending horizontally parallel to the wall 20 of the building 12. The channel 40 has an upper opening 42 which extends along the upper surface 14. A anchor insert 44 extends through the channel 40, having a top face 46 that is exposed through the upper opening 42 in the channel 40. The flashing cap 30 is preferably secured to the anchor insert 44 by screws 45 which extend through the flashing cap 30 and then into the top face 46 of the anchor insert 44. The channel is shaped so that a vertical force acting on the anchor insert 44 is distributed to the molding 10 without ripping the foam around the channel 40 and pulling the anchor insert 44 out of the channel 40. By having a tight fit between the anchor insert 44 and the channel, the molding 10 is indirectly, yet rigidly attached to the flashing cap 30. Thus the flashing cap 30 is held securely to the molding 10 without the need for a plywood intermediate layer.

Figure 2:
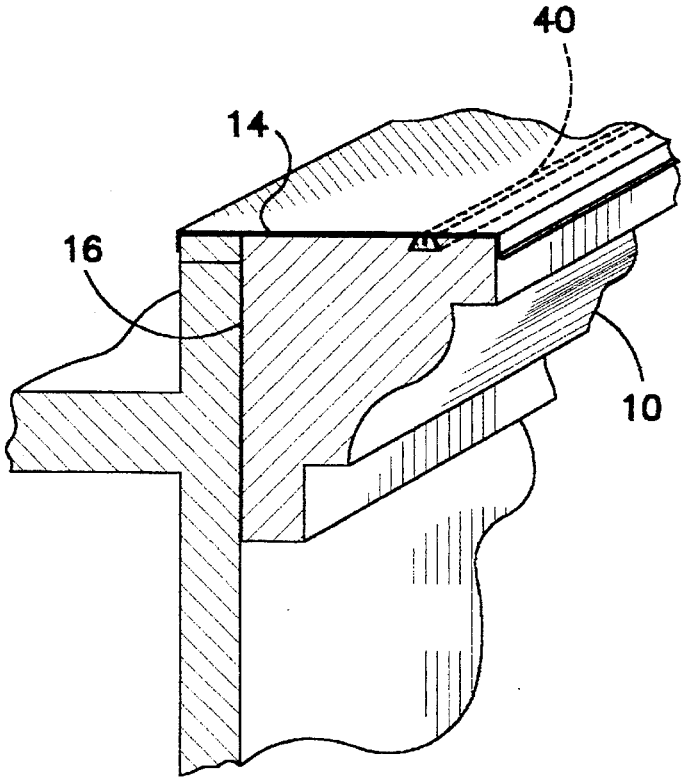
FIG. 2 is a diagrammatic perspective view with parts broken away, taken along line 2—2 in FIG. 1, detailing internal structural elements according to the present invention.

FIG. 2 illustrates that the channel 40 extends lengthwise along the molding 10, thus the channel extends parallel to the upper surface 14 of the molding 10, and to the inner surface 16 of the molding 10. "Lengthwise" refers to a direction orthogonal to the cross section of the molding 10 as illustrated in FIG. 2.

FIG. 5 and 6 illustrate a further embodiment of the invention, in which the channel 40 is cross-sectionally "Dutch hat" shaped, and wherein the anchor insert 44 has a matching "Dutch hat" shape. In the first embodiment, the anchor insert is preferably a "dove-tail" cross-sectioned wood strip. However, in the further embodiment illustrated in FIGS. 5 and 6, the anchor insert 44 is metal and thus has several transverse extensions 48 extending horizontally within the molding 10 to hold the anchor insert 44 securely within the channel 40 which has a matching shape. Other suitable cross sectional shapes for the further embodiment of the anchor insert 44 include t-shapes and right angle shapes.

Once the flashing 30 is securely held in place, appropriate steps can be taken to coat and finish the molding to provide a seamless appearance that matches the rest of the building.

In conclusion, herein is presented a system for securing a molding to a parapet, while eliminating a serious flaw in the current procedure: the intermediate plywood layer between the foam molding and the flashing cap. The flashing cap extends directly over the molding without plywood therebetween. The plywood may be eliminated because of the presence of the anchor insert extending within the foam molding, the anchor insert thereby allowing the flashing cap to be secured to the foam molding.

What is claimed is:

1. A molding flashing installation method, for anchoring a flashing cap to a molding having an upper surface, an inner surface, and a decorative surface to a building having a parapet, comprising:

forming a channel in the molding, the channel extending lengthwise along the molding, the channel having an upper opening in the upper surface;

inserting an anchor insert into the channel;

covering the molding with the flashing cap; and securing the flashing cap to the molding by fastening the flashing cad to the anchor insert.

2. The molding flashing installation method of claim 1, wherein the molding is made of polystyrene foam, the channel has a cross-sectional shape, and wherein the anchor insert has substantially the same cross sectional shape as the channel.

3. The molding flashing installation method of claim 2, wherein the flashing cap extends directly above the upper surface of the molding, and wherein there is no plywood layer therebetween.

4. The molding flashing installation method of claim 2, wherein the cross-sectional shape of the channel is a dove-tail, and wherein the anchor insert is made of wood.

5. The molding flashing installation method of claim 2, wherein the anchor insert is made of metal, having a dutch hat cross sectional shape.

6. A molding installation system, for mounting a decorative fixture to a building having a parapet, and waterproofing the fixture using a flashing cap, comprising:

a molding, the molding having an upper surface, an inner surface, and a decorative surface, the molding further having a channel, the channel extending lengthwise along the molding parallel to the inner surface, the channel having an upper opening in the upper surface; and a anchor insert extending in the channel, the anchor insert having an exposed face at the upper opening of the channel for allowing the flashing cap to be secured to the molding by fastening the anchor insert to the flashing cap.

7. The molding installation system of claim 6, wherein the channel is dove-tail shaped.

8. The molding installation system of claim 6, wherein the molding is formed of polystyrene foam, and wherein the anchor insert is made of wood and is dove-tail shaped.

9. The molding installation system of claim 6, wherein the molding is formed of polystyrene foam, and wherein the anchor insert is made of metal, and has at least two traverse extensions.

* * * * *